US007300576B1

(12) United States Patent
Blake

(10) Patent No.: US 7,300,576 B1
(45) Date of Patent: Nov. 27, 2007

(54) POOL CLEANING SYSTEM AND SAFETY SKIMMER

(75) Inventor: Andy F. Blake, Phoenix, AZ (US)

(73) Assignee: Shasta Industries, Inc., Phoenix, AZ (US)

( * ) Notice: Subject to any disclaimer, the term of this patent is extended or adjusted under 35 U.S.C. 154(b) by 306 days.

(21) Appl. No.: 11/196,655

(22) Filed: Aug. 2, 2005

(51) Int. Cl.
*E04H 4/12* (2006.01)

(52) U.S. Cl. ..... 210/167.1; 210/167.12; 210/416.2; 4/507

(58) Field of Classification Search ..... 210/167.01, 210/167.1, 167.12, 232, 416.1, 416.2; 4/507
See application file for complete search history.

(56) References Cited

U.S. PATENT DOCUMENTS

| | | | | | |
|---|---|---|---|---|---|
| 4,322,860 | A | | 4/1982 | Gould | 4/490 |
| 4,402,094 | A | * | 9/1983 | Sanders | 4/504 |
| 4,426,286 | A | | 1/1984 | Puckett et al. | 210/121 |
| 4,501,659 | A | | 2/1985 | Henk | 210/169 |
| 4,523,606 | A | | 6/1985 | Gould et al. | 137/119 |
| 4,798,670 | A | | 1/1989 | Treene | 210/169 |
| 4,817,991 | A | | 4/1989 | Frentzel et al. | 285/7 |
| 4,818,389 | A | | 4/1989 | Tobias et al. | 210/169 |
| 4,826,591 | A | * | 5/1989 | Macia | 210/167.12 |
| 5,167,041 | A | * | 12/1992 | Burkitt, III | 4/541.2 |
| 5,279,728 | A | | 1/1994 | Weiss | 210/169 |
| 5,338,446 | A | | 8/1994 | Schuman et al. | 210/169 |
| 5,347,664 | A | * | 9/1994 | Hamza et al. | 4/509 |
| 5,750,022 | A | | 5/1998 | Blake et al. | 210/169 |
| 5,753,112 | A | * | 5/1998 | Barnes | 210/167.12 |
| 5,785,846 | A | | 7/1998 | Barnes et al. | 210/169 |
| 5,822,807 | A | * | 10/1998 | Gallagher et al. | 4/507 |
| 6,039,886 | A | | 3/2000 | Henkin et al. | 210/776 |
| 6,082,395 | A | | 7/2000 | Balint | 137/382 |
| 6,253,391 | B1 | * | 7/2001 | Watanabe et al. | 4/504 |
| 6,270,683 | B1 | | 8/2001 | Turner | 210/776 |
| 6,280,611 | B1 | | 8/2001 | Henkin et al. | 210/143 |
| 6,365,039 | B1 | | 4/2002 | Henkin et al. | 210/103 |
| 6,387,250 | B1 | | 5/2002 | Henkin et al. | 210/97 |
| 6,395,167 | B1 | | 5/2002 | Mattson, Jr. et al. | 210/169 |
| 6,468,052 | B2 | | 10/2002 | McKain et al. | 417/306 |
| 6,751,814 | B2 | | 6/2004 | Mattson, Jr. et al. | 4/504 |
| 2006/0112480 | A1 | * | 6/2006 | Sisk | 004/507 |

FOREIGN PATENT DOCUMENTS

| | | | |
|---|---|---|---|
| EP | 0863278 | * | 9/1998 |

* cited by examiner

*Primary Examiner*—Fred G. Prince
(74) *Attorney, Agent, or Firm*—Cahill, von Hellens & Glazer P.L.C.

(57) ABSTRACT

A swimming pool cleaning system includes a pump, a first tube coupling a suction port of the pump in fluid communication with a main drain or mobile cleaning device which draws water and settled debris from the bottom of the pool, and a skimming device including an entrainment nozzle and a safety tube. The entrainment nozzle is coupled by a second tube to a coupling device which diverts a small portion of pool return water pumped from an outlet port of the pump. The safety tube extends from above the water line and above the debris trap in the skimmer to the body of the skimmer below the debris trap. Most of the pool return water is pumped into a rotary distribution valve, various outlets of which are connected to various pool cleaning heads embedded in an inner surface of the pool. A single low-horsepower pump produces simultaneous effective skimming and operation of embedded cleaning heads.

7 Claims, 2 Drawing Sheets

FILTER
PUMP
STRAINER
V
V
V
O
31
31
31

POOL CLEANING SYSTEM AND SAFETY SKIMMER

BACKGROUND OF THE INVENTION

The invention relates to a swimming pool cleaning system in which a single pool pump drawing water only out of a main drain can simultaneously operate a skimmer, a leaf and debris trap device in the suction line, and a plurality of pop-up cleaning heads disposed in floor and/or wall of the swimming pool. It also relates to a safety skimmer that may form a part of the system or be used independently with other pool systems.

Intense summer wind/dust storms are common in various parts of the country, especially the Southwest desert regions, wherein large amounts of leaves, dust, and other debris are deposited in swimming pools, presenting a burdensome cleaning problem. Some known pool cleaning systems agitate the water to keep dust and debris in suspension in the pool water so that the dust and debris are removed by the main pool filter. However, large debris blown into the pool by the intense summer wind/dust storms does not stay in suspension long enough to be filtered and instead settles to the bottom of the pool.

Typical well known components of a swimming pool cleaning system are disclosed in commonly assigned U.S. Pat. No. 4,322,860 "POOL CLEANING HEAD WITH ROTARY POP-UP JET PRODUCING ELEMENT", by Henry D. Gould, issued Apr. 6, 1982, which discloses indexed rotation pop-up cleaning heads for installation in the bottom surfaces of a swimming pool, and U.S. Pat. No. 4,523,606 "DISTRIBUTION VALVE", by Charles M. Gould and Andy F. Blake, issued Jun. 18, 1985, which discloses a rotary distribution valve that sequentially distributes water from the high pressure outlet of a swimming pool pump/filter system into the various pop-up cleaning heads. Commonly assigned U.S. Pat. No. 5,750,022 "VACUUM SYSTEM FOR REMOVAL OF DEBRIS FROM SWIMMING POOLS", by Blake et al., issued May 12, 1998, incorporated herein by reference, discloses a vacuum chamber having an access port, an outlet port connected to a suction inlet of the swimming pool and an inlet port connected to receive water and debris pumped from the bottom of the pool.

U.S. Pat. No. 4,501,659 entitled "SKIMMER APPARATUS FOR SWIMMING POOLS" by Charles R. Henk, issued Feb. 26, 1985, discloses a skimmer in which all of the water returned by the pool pump through the filter to the pool is injected through a venturi or entrainment nozzle into the lower portion of a skimmer chamber. The water ejected by the entrainment nozzle entrains adjacent water in the skimmer body and carries such water through a return tube back into the swimming pool. Such entrainment causes surface water of the pool to flow by action of gravity into the skimmer to replace the entrained water.

The skimmer device described in the Henk patent was marketed by Hayward, Inc. for use in pools in which a bottom port of the skimmer shown by reference numeral 12 in FIG. 7 of the Henk patent housing was connected by a pipe to the suction side of an auxiliary swimming pool pump. The Hayward skimmer was marketed for the purpose of using only its suction port for "normal" skimming, and supplementing such normal skimming in a "turbo" mode by directing all of the return water into the entrainment nozzle when extra skimming was needed. The total amount of water drawn into the skimming inlet of the Hayward skimmer when in its "turbo" mode, was equal to the amount of water drawn by the auxiliary pump from the bottom of the skimmer plus the water entrained by the entrainment nozzle and carried out of the return tube along with the pumped water. The amount of pumped water typically was in the range from 60 to 100 gallons per minute. To achieve simultaneous skimming and operation of pop-up cleaning heads, an additional auxiliary pump would have been needed just for the Hayward skimmer.

It should be appreciated that an owner of a swimming pool having therein even the most effective commercially available automatic cleaning system occasionally may wish to use a conventional manual pool vacuum sweeper to manually vacuum the bottom of the swimming pool and thereby remove accumulated debris such as sand, gravel, leaves or the like more thoroughly and more quickly than can be accomplished by the automatic cleaning system. A conventional manual pool vacuum sweeper includes a long flexible hose coupled to a suitable suction port in the pool water recirculating system. Note that some settled debris, such as sand or gravel, may be too heavy to be effectively moved by the cleaning head jets to move it to the main drain. Or, the debris may be too large to pass into the main drain and hence into the strainers or filters of the pool cleaning systems.

In all known swimming pool cleaning systems, water drawn through a manual pool vacuum sweeper and into a suction port of the pool cleaning system passes through the main pump and main filter. The amount of flow of such "vacuumed" water is limited by the capacity of the main pump. It would be desirable to provide a manual vacuuming capability in an automatic pool cleaning system which exceeds the debris holding capacity of the "hair and lint basket" of the main pump. It also would be desirable to avoid damage to the pump impeller by heavy debris which is manually "vacuumed" from the bottom of the pool in the manner described above.

The present invention, permits an "integrated" swimming pool cleaning system using only a single low horsepower pump (eg., one horsepower) to simultaneously provide the combination of good skimming, effective operation of pop-up cleaning heads embedded in the bottom and/or side walls and/or steps of the swimming pool, and removal and trapping of leaves and debris from the bottom of the swimming pool, either through a main drain or a mobile robotic cleaning device which moved along the bottom of the swimming pool. Further, the present invention provides those features while presenting a safety skimmer for avoiding entrapment of a swimmer when a skimmer may become clogged or blocked by the accumulation of excessive debris—an event that may happen frequently after windstorms.

Note that in prior pool cleaning systems for large pools in which multiple skimmers were desired, suction provided by a single low horsepower pump had to be divided among the multiple skimmers, and the result usually was that adequate skimming could not be simultaneously achieved by all of the skimmers from the suction provided by the single pump.

SUMMARY OF THE INVENTION

Accordingly, it is an object of the invention to provide an improved skimming system for a swimming pool to provide effective skimming while using only a small portion of the full pumping capability of a single conventional swimming pool pump while providing safety against entrapment of swimmers in contact with return tubes of skimmers.

It is another object of the invention to provide an integrated swimming pool cleaning system which, with only a single swimming pool pump, which can simultaneously and efficiently operate a plurality of skimmers and a leaf debris removal device which traps leaves and debris which have settled to the bottom surface of a swimming pool while providing safety against entrapment of swimmers in contact with return tubes of skimmers.

It is another object of the invention to provide a skimmer incorporating an entrainment nozzle combined with a safety tube to prevent entrapment of swimmers contacting the return tube.

Briefly described, and in accordance with one embodiment thereof, the invention provides a swimming pool cleaning system including a pump, a first tube coupling a suction port of the pump in fluid communication with a main drain or mobile cleaning device which draws water and settled debris from the bottom of the pool, and a skimming device including an entrainment nozzle and a safety tube. The entrainment nozzle is coupled by a second tube to a coupling device which diverts a small portion of pool "return" water pumped from an outlet port of the pump. The safety tube communicates at one end thereof to an area within the skimmer that is above water level and is at atmospheric pressure. The other end of the safety tube communicates with the area of the skimmer that is below the water surface and below the debris trap. In the described embodiment, most of the pool return water is pumped into a rotary distribution valve, the outlet ports of which are connected to various pool cleaning heads embedded in an inner surface of the pool. In the described embodiment, a vacuum canister having a removable cover to allow access to a removable debris trap disposed therein between an inlet and an outlet thereof is coupled between a suction inlet of the pump and the main drain or mobile cleaning device.

DETAILED DESCRIPTION OF THE PREFERRED EMBODIMENTS

Figure 1:
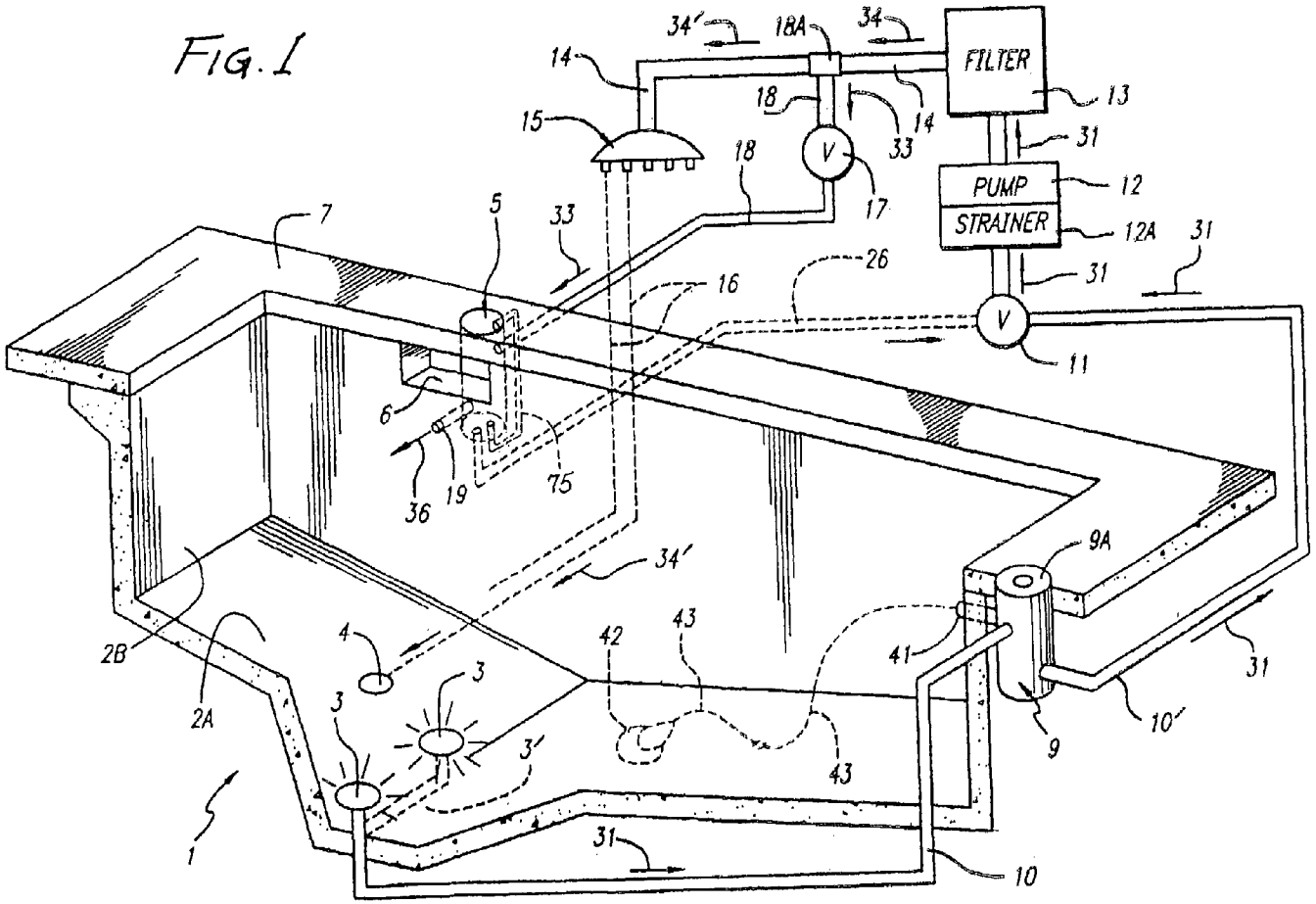
FIG. 1 is a partial perspective view illustrating the integrated swimming pool cleaning system of the present invention incorporating a safety skimmer.

Referring now to the drawings, swimming pool 1, which includes a bottom 2A and inner walls 2B surrounded by a conventional pool deck 7, further includes an integrated pool cleaning system. The pool cleaning system may include a conventional one horsepower pump 12 having its high pressure outlet coupled to the inlet of a filter 13. The outlet of filter 13 is connected by a tube 14 to an inlet of a rotary distribution valve 15 of the type described in above referenced U.S. Pat. No. 4,523,606, the various distribution outlet ports of which are each connected to one or more pop-up heads 4 disposed in the bottom 2A of the swimming pool. For convenience, only one connection between a distribution outlet of distribution valve 15 is shown, and is indicated by dotted line 16.

The suction inlet of pump 12 is connected by a tube 10', a vacuum canister 9, and a tube 10 to a pair of main drains 3 located in the lowest portion of pool bottom 2A. Vacuum canister 9 is connected between tubes 10 and 10'. Main drains 3 are separated by several feet and coupled by a balance tube 3' to prevent vacuum entrapment of a person against the bottom 2A of the pool. A removable porous trap is disposed between the inlet and outlet ports of vacuum chamber 9, which are connected to tubes 10 and 10', respectively. The removable porous trap can be accessed through a removable cover 9A (which forms a vacuum seal with vacuum chamber 9), emptied, and placed back in canister 9. This leaf/debris trapping canister is described in detail in the above mentioned issued U.S. Pat. No. 5,750,022 incorporated herein by reference.

Figure 2:
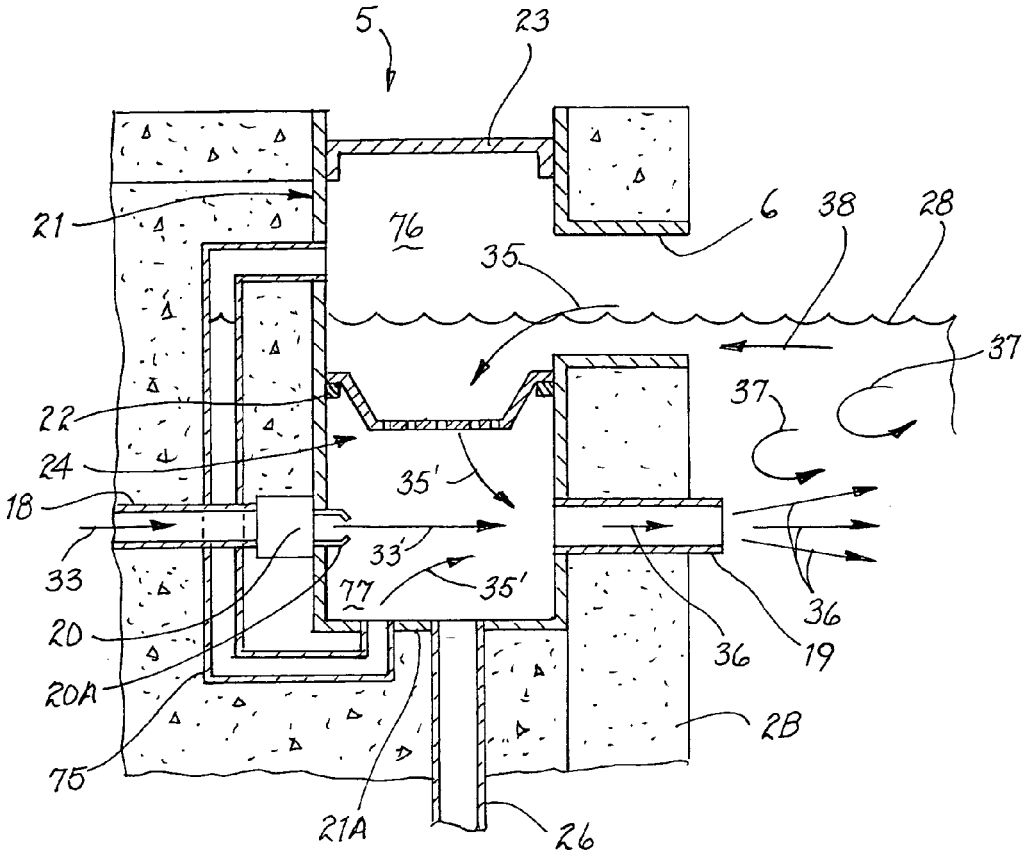
FIG. 2 is a side sectional view of the safety skimmer of the present invention.

Skimmer 5 includes a cylindrical body 21 (FIG. 2) having an inlet 6 that extends through vertical wall 2B and opens into the swimming pool so that water "skimmed" from the surface 28 of the swimming pool flows into the skimmer body 21. A suitable foraminous or porous basket or trap 24 has a circumferential upper lip that rests on a circumferential ledge 22 within body 21. A conventional removable lid 23 allows access to the inside of skimmer 5, so that debris trap 24 can be removed and emptied of floating debris which have been trapped or filtered from the skimmed water.

In accordance with the present invention, one end of a tube 18 is connected by a suitable coupler to an entrainment nozzle 20 that extends through the wall of skimmer body 21 below debris trap 24. The other end of tube 18 is connected by an optional on/off valve 17 and a Tee-connector 18A to above described tube 14. A portion 33 of the "return" water flow 34 from filter 13 is diverted as indicated into tube 18 and flows into entrainment nozzle 20. The remaining portion 34' of the return water flow 34 flows into rotary distribution valve 15 and the pop-up cleaning head or heads 4 connected to the presently selected outlet port of distribution valve 15. (In a typical system, each outlet port of distribution valve 15 feeds two or more pop-up cleaning heads 4, and all of the return water from the outlet of filter 13 except the diverted water through skimmer 5 passes through the presently selected outlet port of distribution valve 15 into the pop-up heads 4 connected to that port. Floor cleaning pop-up heads typically require 15-20 gallons per minute flow to be optimally effective. Step or bench cleaning heads typically require about 5 gallons per minute flow to be most effective.

The water jet 33' ejected by narrowed portion 20A of entrainment nozzle 20 is coaxially aligned with return tube 19, and entrains "skimmed" water, i.e., pool surface water that has flown through inlet 6 into the lower portion of skimmer body 21, as indicated by arrows 35. The combination of return water 33' ejected from entrainment nozzle 20 and water entrained by the jet 33' is forced through return tube 19 and returned into the swimming pool as a diverging jet 36, which expands in diameter, and, if not deflected, may surface roughly 5-10 feet from skimmer 5, producing surface currents which move away from skimmer 5. The outlet of entrainment nozzle 20A can be 2-3 inches from the inlet of return tube 19.

FIG. 1 shows in dotted lines a suction tube 26 connected by optional valve 11 to the suction inlet of pump 12. Valve 11 allows part or all of the water pumped into the suction inlet of pump 12 to be diverted to tube 26. The tube 26 allows the pool owner to connect a hose to the port of tube 26 inside of skimmer 5 to manually "vacuum" the bottom of the pool, or to pass pool surface water drawn into the skimmer inlet 6 to be filtered by filter 13; this might be very desirable to remove oil or the like floating on the surface of the pool.

Pump 12 may be, for example, a one horsepower unit, and is capable of drawing roughly 60 to 100 gallons per minute of water (depending on the amount of water friction is present in the particular pool plumbing) into its suction port, as indicated by arrows 31, through tubes 10 and 10', debris collection canister 9, and main drain 3. The amount of water recirculated by pump 12 depends mainly upon how much resistance-producing debris has accumulated in the debris collection canister 9 and the amount of fluid resistance opposing "return" water from the outlet of filter 13 through the one or more pop-up cleaning heads 4 presently selected by rotary distribution valve 15.

In accordance with the present invention, only a small portion 33 (typically 5 to 10 gallons per minute) of the 60 to 100 gallons per minute of return water from the outlet of filter 13 is diverted through tube 18 into the entrainment nozzle 20 in skimmer 5. The preferred inside diameter of the outlet opening 20A of threaded, removable entrainment nozzle 20 is ¼ of an inch for the above indicated 5-10 gallon per minute diverted return flow. (A ⅝ inch inside diameter of portion 20A of entrainment nozzle 20 also is effective; a larger diameter entrainment nozzle may result in a greater amount of skimming than is really needed, at the cost of making the pop-up floor cleaning heads 4 ineffective by diverting too much of the flow 34 to the skimmer 5 so that not enough is available for cleaning heads 4.

Return tube 19 may be, for example, a 12 inch section of conventional 2 inch PVC pipe. If desired, a deflector (not shown) can be attached to the outlet of return tube 19 to change the recirculation pattern of water in the swimming pool and/or to prevent jet 36 from "surfacing". However, such a deflector will decrease the amount of water entrained.

It is believed that the above described skimmer, by using a large diameter, short return tube 19 with minimal flow restriction to create back pressure against the ejected jet 33' allows the relatively small 5-10 gallons per minute diverted flow 33 from the outlet of filter 13 to produce a jet 33' that entrains a very large amount of "adjacent" water in the lower part of skimmer body 21. This produces surface skimming action approximately as effective as that of the skimmer described in the Henk patent and marketed by Hayward, Inc, but using a far smaller portion of the pumped return water and without necessitating use of the full pumping capacity of a pump just to operate the skimmer. As a result, the large remaining portion 34' of the return water from pump 12 can be used for simultaneously operating pop-up cleaning heads 4 at essentially full efficiency.

It has been found that if the debris trap 24 becomes blocked, such as by the accumulation of an excessive amount of debris, the suction created by the suction tube 26 is sufficient to create a negative pressure in the skimmer body below the debris trap even though water continues to flow through the entrainment nozzle 20. This negative pressure can reverse the flow through the return tube 19 and create a hazardous condition in the event a swimmer comes into contact with the return tube while the debris trap is blocked. To avoid this entrapment scenario, the present invention provides a safety tube 75 communicating at one end thereof with an area 76 in the skimmer body above the water surface 28 at the other end thereof to an area 77 in the skimmer body below the debris trap 24. Thus, if a swimmer contacts the return tube at a time when the debris trap is blocked, the suction existing at the end of the tube would normally trap the swimmer against the tube; this is particularly true if the swimmer is a child. The safety tube of the present invention effectively delivers atmospheric pressure, existing above the water level in the area 76, to the area 77 within the body of the skimmer and to the return tube 19 to thereby relieve the suction the would otherwise trap the swimmer against the return tube.

What is claimed is:

1. A pool cleaning system for a swimming pool, comprising in combination:

(a) a water recirculating system including a pump having a suction port and an outlet port;

(b) at least one skimming device including i. a hollow body having a skimming inlet and an open top, and a removable lid covering the open top to allow access to a removable porous debris trap disposed in the body below the skimming inlet, ii. an entrainment nozzle in the body beneath the debris trap coupled in fluid communication with the outlet port;

iii. a return tube extending from the body beneath the debris trap and positioned to receive a jet of water ejected from the entrainment nozzle and water entrained by the jet, to thereby remove water from the body of the skimming device and cause gravity flow of pool surface water into the body through the skimming inlet;

iv. a suction tube having an end thereof communicating with the body beneath the debris trap and another end thereof connected to said suction port; and, v. a safety tube having one end thereof in communication with the body beneath the debris trap and another end thereof in communication with the atmosphere above the debris trap to thereby prevent the entrapment of a swimmer in contact with the return tube.

2. The pool cleaning device of claim 1 wherein the pump pumps approximately 60 to 100 gallons per minute of pool water into its suction port, out of its outlet port, and through a filter, water exiting the filter delivering only approximately 5-10 gallons per minute of pool return water into the entrainment nozzle of the skimming device.

3. The pool cleaning system of claim 2 wherein the entrainment nozzle includes a narrowed ejection nozzle passage having an inside diameter of approximately ¼ of an inch coaxial with the return tube, the return tube being composed of an approximately 12 inch section of 2 inch PVC pipe.

4. A skimming device for use in a swimming pool cleaning system having a water recirculating system including a pump having a suction port and an outlet port, comprising:

(a) a hollow body having a skimming inlet and an open top, and a removable lid covering the open top to allow access to a removable porous debris trap disposed in the body below the skimming inlet, (b) an entrainment nozzle in the body beneath the debris trap coupled in fluid communication with the outlet port;

(c) a return tube extending from the body beneath the debris trap and positioned to receive a jet of water ejected from the entrainment nozzle and water entrained by the jet, to thereby remove water from the body of the skimming device and cause gravity flow of pool surface water into the body through the skimming inlet;

(d) a suction tube having an end thereof communicating with the body beneath the debris trap and another end thereof connected to said suction port; and, (e) a safety tube having one end thereof in communication with the body beneath the debris trap and another end thereof in communication with the atmosphere above the debris trap to thereby prevent the entrapment of a swimmer in contact with the return tube.

5. In a pool cleaning system for a swimming pool having a water recirculating system including a pump having a suction port and an outlet port, a skimming device comprising:

(a) a hollow body having a skimming inlet and an open top, and a removable lid covering the open top to allow access to a removable porous debris trap disposed in the body below the skimming inlet, (b) an entrainment nozzle in the body beneath the debris trap coupled in fluid communication with the outlet port;

(c) a return tube extending from the body beneath the debris trap and positioned to receive a jet of water ejected from the entrainment nozzle and water entrained by the jet, to thereby remove water from the body of the skimming device and cause gravity flow of pool surface water into the body through the skimming inlet;

(d) a suction tube having an end thereof communicating with the body beneath the debris trap and another end thereof connected to said suction port; and, (e) a safety tube having one end thereof in communication with the body beneath the debris trap and another end thereof in communication with the atmosphere above the debris trap to thereby prevent the entrapment of a swimmer in contact with the return tube.

6. A pool cleaning system for a swimming pool, comprising in combination:

(a) a water recirculating system including a pump having a suction port and an outlet port;

(b) at least one skimming device including i. a hollow body having a skimming inlet positioned at water level and an open top, and a removable lid covering the open top to allow access to a removable porous debris trap disposed in the body below the skimming inlet, ii. an entrainment nozzle in the body beneath the debris trap coupled in fluid communication with the outlet port;

iii. a return tube extending from the body beneath the debris trap and positioned to receive a jet of water ejected from the entrainment nozzle and water entrained by the jet, to thereby remove water from the body of the skimming device and cause gravity flow of pool surface water into the body through the skimming inlet;

iv. a suction tube having an end thereof communicating with the body beneath the debris trap and another end thereof connected to said suction port; and, (v) a safety tube extending into said body and terminating at one end thereof beneath the debris trap and extending at another end thereof into said body above said debris trap and above the water level in said body.

7. A swimming pool skimmer comprising (a) a hollow body having a skimming inlet positioned at water level and an open top, and a removable lid covering the open top to allow access to a removable porous debris trap disposed in the body below the skimming inlet, (b) an entrainment nozzle in the body beneath the debris trap coupled in fluid communication with an outlet port;

(c) a return tube extending from the body beneath the debris trap and positioned to receive a jet of water ejected from the entrainment nozzle and water entrained by the jet, to thereby remove water from the body of the skimmer and cause gravity flow of pool surface water into the body through the skimming inlet; and (d) a suction tube having an end thereof communicating with the body beneath the debris trap and another end thereof connected to a suction port; the improvement comprising a safety tube extending into said body and terminating at one end thereof beneath the debris trap and extending at another end thereof into said body above said debris trap and above the water level in said body.

* * * * *